US006708616B2

(12) United States Patent
Faulhammer et al.

(10) Patent No.: US 6,708,616 B2
(45) Date of Patent: Mar. 23, 2004

(54) METHOD OF ADJUSTING TWO ROLLERS THAT CAN BE PLACED ON EACH OTHER IN A PRINTING UNIT

(75) Inventors: Holger Faulhammer, Stuttgart (DE); Bernhard Wagensommer, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/112,539

(22) Filed: Mar. 28, 2002

(65) Prior Publication Data

US 2002/0139266 A1 Oct. 3, 2002

(30) Foreign Application Priority Data

Mar. 29, 2001 (DE) ..... 101 15 496

(51) Int. Cl.[7] ..... B41F 31/30; B41F 5/00

(52) U.S. Cl. ..... 101/483; 101/351.1; 101/216; 101/352.01; 101/148

(58) Field of Search ..... 101/DIG. 45, 450.1, 101/483, 485, 486, 147, 148, 351.1, 352.01, 218, 247, 216

(56) References Cited

U.S. PATENT DOCUMENTS 4,127,067 A * 11/1978 Dahlgren et al. ..... 101/451
4,817,883 A * 4/1989 Hoffmann et al. ..... 242/534
5,142,977 A 9/1992 Gertsch et al.
5,355,796 A 10/1994 Köbler et al.
5,448,949 A * 9/1995 Bucher ..... 101/216
5,485,785 A 1/1996 Schneider et al.
5,540,145 A * 7/1996 Keller ..... 101/148
6,244,174 B1 * 6/2001 Sirowitzki et al. ..... 101/212

FOREIGN PATENT DOCUMENTS

| | | |
|---|---|---|
| DE | 38 25 517 A1 | 2/1990 |
| DE | 41 06 082 A1 | 10/1991 |
| DE | 42 11 379 A1 | 10/1993 |
| DE | 197 40 480 A1 | 3/1999 |
| EP | 0 662 046 B1 | 7/1995 |

* cited by examiner

*Primary Examiner*—Stephen R. Funk
*Assistant Examiner*—Leo T. Hinze
(74) *Attorney, Agent, or Firm*—Laurence A. Greenberg; Werner H. Stemer; Ralph E. Locher

(57) ABSTRACT

In order to achieve a good printed result, it is important that the rollers that interact with each other are arranged at a suitable distance from each other, so that they act on each other with the pressure as stipulated. In order to set the rollers, use is made of a stripe, in particular an ink stripe, which results from contact between the rollers in the rest state. After the transfer, i.e., the formation of the strip, the relevant roller must be rotated into a position wherein the printing machine operator can have access to the ink stripe. As a result of the safety devices provided in printing units, it is generally not possible to detect, however, when the ink stripe on the roller appears in the suitable position. The invention provides a remedy here, in that it is proposed to rotate the roller into the viewable position at a suitable speed, or, by using a special program, taking into account a predefined rotational angle, to move the rollers automatically into the viewable positions.

4 Claims, 2 Drawing Sheets

METHOD OF ADJUSTING TWO ROLLERS THAT CAN BE PLACED ON EACH OTHER IN A PRINTING UNIT

BACKGROUND OF THE INVENTION

Field of the Invention

The invention relates to a method of adjusting two rollers that can be placed on each other and transfer a substance such as moisture or ink, with the aid of a stripe which is formed on the roller that accepts the substance when the rollers contact each other and which is subsequently measured. The invention further pertains to a printing unit having a control system that can be programmed via a memory.

One important precondition for good inking and dampening of the printing plates is exact setting of the inking and dampening rollers. The inking rollers ensure satisfactory transport of the printing ink from the ink fountain via the ink applicator rollers to the printing plate. In the case of the dampening rollers, it is a matter of satisfactory dampening, which is ensured only when, by means of good adjustment of the dampening-solution applicator rollers in relation to the plate and in relation to the dampening-solution driver, the preconditions for this are provided. As a result of poor adjustment or setting of the inking rollers, it is possible for a deficient transfer of ink to the printing material to occur. If the dampening rollers are set poorly, nonuniform dampening occurs. To some extent, the printing plate receives too little water, to some extent too much water. As a result, the printing plate becomes dry or else so-called water smudges can be seen in the printed product.

The foregoing statements concerning the dampening rollers apply in particular to printing units with planographic printing, and specifically offset printing machines. With regard to inking rollers, the statements made above apply to all printing machines wherein the ink is distributed via rollers and applied to the printing plate. This applies both to ductor inking units and to film inking units.

The metering of the printing ink is carried out via different ink splitting openings in the various inking zones. Regulating the quantity of ink over the entire width is carried out by changing the rotational speed of the ductor. The further transport (ink flow) of the ink stripe metered accurately by the printing machine operator (pressman) is performed, from the ink ductor, by the transfer, distribution, intermediate and distributor rollers arranged subsequently in the inking unit. There, the layer of printing ink is repeatedly distributed and split by the alternating arrangement of hard and soft rollers with different diameters and is distributed by friction by rollers which reciprocate laterally (distributor rollers). In the process, current inking units are calculated in such a way that, as a rule, the main flow of printing ink takes place on to the first two ink applicator rollers. The two last applicator rollers have substantially the task of equalizing the ink film on the plate. In addition to the transport and the distribution, however, the arrangement of the various rollers simultaneously also fulfills the task of ink storage. Finally, during continuous printing, the same amount of ink must immediately be available for renewed inking when, as a result of transfer to the rubber blanket, a specific amount of ink has been used up. In addition to the ink distribution in the circumferential direction, there is lateral distribution by means of traversing rollers. As a result, the ink remains supple, it is not possible for any accumulations of ink to form, and the traversing rollers are, moreover, an aid in setting the inking zones.

It follows from the foregoing that the setting of the individual rollers in relation to each other is particularly important for the printed result. For setting and checking the position of the rollers in relation to one another, numerous proposals have therefore been made. Checking the ink applicator rollers in relation to the printing plate is carried out by firstly the correctly backed printing plate being gummed uniformly thinly and subsequently dried. The machine is then hinged forward to such an extent that the printing plate is under all four or five applicator rollers. Then, with the aid of the "rollers on" lever, the applicator rollers provided with printing ink are set against the printing plate and then lifted back into the off position again immediately. This procedure can be repeated in order that the ink stripe on the printing plates can also be seen easily. If the ink applicator rollers are well adjusted, a uniform ink stripe about three to four millimeters wide from each roller must manifest itself on the plate. If this is not the case, regulation must be carried out with the aid of the setting screws present on each offset printing machine.

U.S. Pat. No. 5,485,785 (European patent EP 0 662 046 B1) describes a method and an apparatus for setting the pressure of a roller provided with a plastic cover in rotary printing machines. This reference is based on the fact that the position of the rollers in relation to one another is in a normal position at the start. This reference is based on the problem that the rollers can heat up during the printing operation, so that the position of the rollers in relation to one another and therefore the pressure exerted on one another changes. Therefore, the pressure exerted on one another by the rollers depends on the temperature. The object of that prior art is therefore to readjust the rollers in such a way that they exert a constant pressure on one another irrespective of the temperature. The object is achieved in that one of the rollers can be varied in terms of its position with respect to the roller resting on it by a hydraulic actuator as a function of the temperature. There, it is assumed that the two rollers already have a prescribed setting at the start of the regulation operation, the setting then being maintained by the regulating device even during temperature changes. A proposal as to how the two rollers are to be aligned in relation to each other at the start and how such a measurement can be carried out is not made in the publication.

U.S. Pat. No. 5,142,977 (German published patent application DE 38 25 517) describes a device for setting inking unit and dampening unit rollers on and off and setting them in a printing machine. There, the individual rollers operating with one another in an offset printing machine are also described, so that such a printing machine does not have to be described again at this point. In that reference, too, the possibility is described of setting the rollers in relation to one another with the aid of electrically operated actuating devices. One proposal mentioned there discusses determining the action of force of two rollers on each other with the aid of a force measuring cell. Another proposal made there discusses placing the rollers against each other briefly and then measuring the stripe produced in this way. In the case of inking rollers, this is then the ink stripe to be measured. It is already known to produce an (ink) stripe by allowing two rollers (for example inking rollers) to run against each other and then stopping the rollers. In this way, too, a stripe along the line of contact with which the rollers rest on each other is formed by the adhesion of the moist ink (at the points resting on each other for a relatively long time). The stripe width thereby depends on the pressure of the two rollers resting on each other and the duration of contact or the duration of the stoppage of the rollers. Since the rollers are always stopped for a defined time, the stripe width in a printing machine then always depends only on the pressure of the rollers against each other. The ink stripes are generally measured manually. In this case, the procedure is such that a copy of the ink stripe is prepared, at least in some sections, by placing a paper on the roller provided with the ink stripe. This copy can then be measured by the printing machine operator. However, in order to be able to prepare the copy, the printing machine operator must be able to make access to the roller. It must therefore be within his range. In that case, various difficulties arise. Firstly, although in theory, after the formation of the ink stripe, the printing machine operator can move the roller step by step, by inching the roller drive, into an angular position wherein the ink stripe points in the direction of the printing machine operator, this is possible only with great difficulty in practice, since the safety devices which are switched on by the continuous movement of the roller deny the printing machine operator a view of the ink stripe or the access of the printing machine operator to the ink stripe. Since the printing machine operator cannot therefore detect where the ink stripe is currently located on the roller and when the ink stripe has moved into the access range of the printing machine operator, it is very difficult to move the roller into the desired position by inching the drive. In addition, additional stripes are also produced by the inching, and can ensure confusion. It is therefore necessary to strive to move the roller uniformly into the position wherein the printing machine operator can detect the ink stripe and can make access to it. For these reasons, there is the difficulty of measuring the ink stripe formed by inking rollers resting on each other.

SUMMARY OF THE INVENTION

It is accordingly an object of the invention to provide a method and a printing unit which overcome the above-mentioned disadvantages of the heretofore-known devices and methods of this general type and which allow an ink stripe that is needed to set up the rollers in relation to one another can be measured in a simple way.

With the foregoing and other objects in view there is provided, in accordance with the invention, a method of determining a mutual adjustment of two rollers, which comprises:

- placing a first roller carrying a medium selected from the group consisting of moisture medium and ink in contact with a second roller;
- transferring an amount of the medium from the first roller to the second roller and thereby forming a stripe of the medium on the second roller;
- rotating the rollers into a position suitable for measuring the stripe on the second roller, and thereby rotating the rollers so slowly as to allow protective devices of a device wherein the rollers are mounted to remain open; and
- when the second roller has reached the position suitable for measuring the stripe, measuring the stripe of the medium on the second roller.

In other words, the principle of the invention consists in making use of the fact that there is a possibility of moving the rollers without safety devices blocking the view and the access to the rollers. This possibility of driving the rollers without the safety device hampering the view of the printing machine operator of the roller, exists when the rotational speed of the rollers falls below a specific speed. This is because, at such a low speed of the rollers, the protection may be opened to a limited extent. This then provides the printing machine operator with the possibility, as a result of inching the drive, to move the rollers or, even better, as a result of uniform onward rotation of the rollers, to move the latter into a position wherein the stripe on the roller having the stripe can be detected easily. In this position, wherein, in the holding state of the rollers (opened safety device), access can also be made easily to the stripe, in particular the ink stripe on the roller, the slowly rotating rollers are then stopped and the copy of the ink stripe necessary for measurement purposes is prepared.

Further above, it has already been emphasized that ink stripes can occur on different rollers. This may be the case, for example, in a printing plate on which, as already described further above, the ink stripes from the applicator rollers are imaged. The formation of the ink stripes can take place as a result of the applicator rollers provided with printing ink being lowered briefly onto the printing plate and immediately lifted into the normal position again. In addition, as described in U.S. Pat. No. 5,142, 977 (German DE 38 25 517), the ink stripe can be formed on the distributor roller against which the inking unit roller is placed. Another, preferred method consists in stopping the inking rollers acting against one another. The present invention can be applied to all these methods of stripe formation and different roller types. An inching speed of 60 revolutions per hour has proven to be a very beneficial rotational speed. This corresponds to a surface speed of one meter per minute. During this continuous movement, a guard may be opened to a limited extent, and the stripe can be viewed without difficulties during positioning.

With the above and other objects in view there is also provided, in accordance with the invention, a printing unit, comprising:

- a first roller and a second roller mounted to be brought into contact with one another for transferring from the first roller to the second roller a substance selected from the group consisting of moisture and ink and thereby form a stripe of the substance on the second roller;
- a control system connected to operate the rollers and having a memory having stored therein a distance to be traversed by the rollers so as to rotate the stripe formed on the second roller into a position in which the stripe can be measured well.

Finally, there is also provided, in accordance with the invention, a measuring device in a printing machine for measuring a stripe on a printing machine roller, comprising an electro-optical measuring device disposed to measure the stripe on the printing machine roller. The electro-optical measuring device may be a linear CCD or a laser array.

Further above, it has already been explained that an entire series of printing machines are provided with control systems programmed via memories. On the other hand, a rotational angle may be specified through which the roller provided with an ink stripe must be rotated (for example from the holding position) in order that it reaches its position which is optimal for access by the printing machine operator. For such a printing unit, there is incorporated an additional program in the control program of the printing machines, the additional program at least arranging for the roller, after the formation of an ink stripe, to be moved through a defined angle into the position that is optimal for the measurement by the printing machine operator. This results in a number of advantages. Firstly, with the safety device closed, the roller can be moved into the position wherein the stripe is then visible after the safety device has been opened. Since the roller is moved automatically into the correct position and is stopped there automatically, it is not necessary for the printing machine operator to be able to see, with the safety device opened, how the ink stripe on the roller is moved into the position suitable for him, where he can then stop the roller.

This means that a very much higher rotational speed can be selected for the roller. Furthermore, the printing machine does not have to be moved specifically in a slow mode, which has to be set up separately. Furthermore, after the execution of the program, the angular position of the stripe or ink stripe is defined unambiguously, so that there is the option of permitting the stripe also to be measured by automatic means (automatic machines).

In a development of the invention according to claim 4, it is recommended not only for the rotation of the roller provided with an ink stripe from the contact position into the viewing position to be programmed, but also, in addition, at least some of the steps which are necessary in order to form the ink stripe. Therefore, the actions of starting the printing machine, including the ink distribution, stopping the rollers in order to form a stripe or ink stripe and rotating the ink stripe out into the visible position proceed substantially automatically. A measure of this type not only saves time but also permits the measurement of a stripe even by a printing machine operator who has less experience in setting up the printing machine.

Since, by means of the programmed sequence, the angular position of the roller with the ink stripe is defined at the end, the possibility also results of carrying out the measurement of the stripe or ink stripe by means of an automatic machine, such as a scanner. In this case, there are very different measures relating to measurement. For example, the ink stripe can be scanned by a light or laser beam. The reflective radiation may then be measured by a sensor.

Another development relating to measuring the stripe consists in the use of an electro-optical device which, for example, can be provided with a laser line or a linear CCD. This line is able to measure the optically illuminated stripe directly on the roller, without an ink stripe first having to be copied by means of a paper web. This can be done by the linear CCD extending or being moved over the entire length of the stripe, parallel to the letter.

The measuring device can be used not only to measure the stripe width of a single roller. Instead, with the aid of the measuring devices, the stripes on a plurality of rollers can be measured one after another. One development makes use of the fact that, in a printing machine, a plurality of rollers are arranged parallel to and close beside one another. If, therefore, the measuring device is arranged on a pivot axis running parallel to the longitudinal axes of the rollers, then by pivoting the measuring device, a plurality of rollers may be scanned one after another and their stripes may therefore be measured. As already described further above, the length of the rollers is scanned by the measuring device being displaced on the pivot axis, parallel to the longitudinal axis of the relevant roller.

Further above, the possibility has already been explained, after two rollers have been laid on each other to form a stripe, of rotating the roller through a predefined rotational angle on the basis of a stored control signal, in order to bring the relevant roller into a position wherein the stripe can be read well. With the aid of an additional development, it is then possible, without a corresponding pre-programmed control signal, to move the relevant roller into the position wherein the stripe can easily be measured. For this purpose, the measuring device is aimed at the relevant roller and the roller is stopped by an output signal from the measuring device as soon as the measuring device detects that the roller is in the desired position.

In an advantageous development of the invention, a long line which extends over the entire length of the stripe is not set up. Instead, a small CCD sensor is moved along the stripe, the latter being scanned. Since the respective position of the sensor is known, the respective width of the stripe over its length can be described by the sensor. However, the measured width of the stripe at a specific location of the sensor corresponds to the pressure conditions to which the roller was previously subjected at this point when the two rollers were resting on each other. A further simplification of the measurement may be achieved by the respective line being arranged transversely with respect to the direction of the ink stripe, so that the line always measures the respective width of the ink stripe at a point only linearly. By scanning the ink stripe over its entire length, the pressure distribution along the roller can be determined very accurately. With the aid of the measuring device, as already explained further above, it is not only possible to measure the stripe on a single roller. Instead, the stripes on a plurality of rollers can be measured one after another. In a development of the invention, a pivot axis, about which the measuring device can be rotated, is used for this purpose. This pivot axis lies parallel to the longitudinal axes of the rollers to be measured. In this case, it is possible to pivot the measuring device about a threaded spindle, on which the measuring device is displaced along the roller. However, it is also possible to place the pivot axis parallel to the threaded spindle.

Other features which are considered as characteristic for the invention are set forth in the appended claims.

Although the invention is illustrated and described herein as embodied in a method of adjusting two rollers that can be placed on each other in a printing unit, and printing unit for implementing such a method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
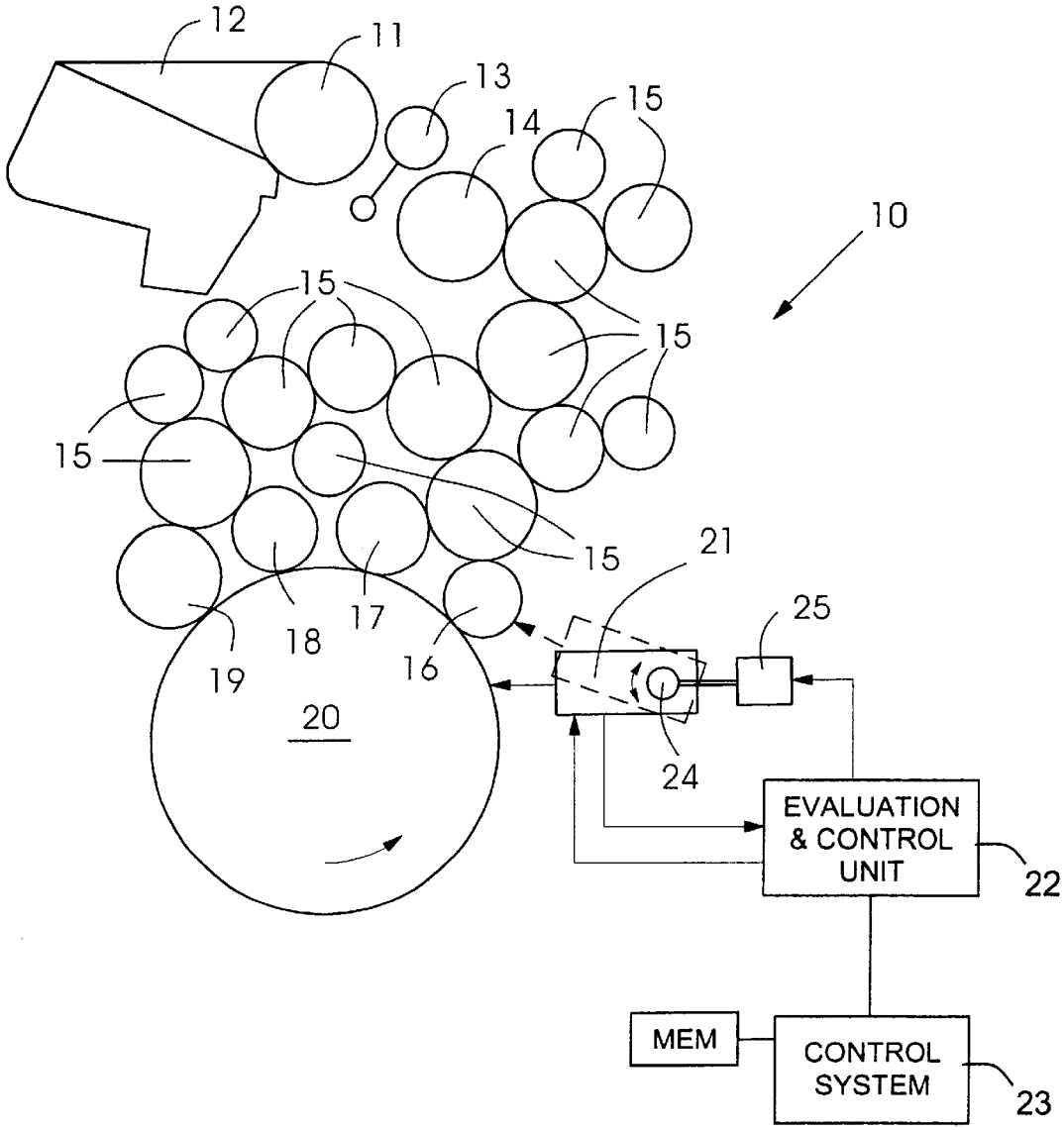
FIG. 2 is a diagrammatic side elevational view of a portion of a printing machine with the device according to the invention.

Referring now to the figures of the drawing in detail and first, particularly, to FIG. 2 thereof, there is shown an ink train or inking unit 10, wherein, ink is transferred from an ink source to an imprint onto printing material. An ink ductor 11 first conveys a quantity of ink required for the printed image and corresponding to an inking zone opening out of an ink fountain 12. An ink ductor 13, which is pivotably arranged such that it can pivot to and fro between the ink ductor 11 and a first inking unit roller 14 transfers the printing ink into the inking unit 10 by rolling its surface firstly on the ink ductor 11 and then on the first inking unit roller 14. Via a large number of ink distributor rollers 15, the ink, as already described at the beginning, is evened and made supple, before the ink is applied by the ink applicator rollers 16, 17, 18, 19 to a printing form on a form cylinder 20, such as a printing plate mounted on the plate cylinder 20.

A CCD sensor 21, or a laser array 21, can advantageously be used to scan the ink stripe on the printing plate and, as a result, to generate a signal which corresponds to the width of the ink stripe. The signal is supplied to an evaluation and control unit 22, which is connected to the machine control system 23. As a result, an automatic sequence of setting the ink applicator rollers 16, 17, 18, 19 on, rotating the plate cylinder 20 and scanning the ink stripe applied can be performed.

In an advantageous refinement, the CCD sensor is pivotably arranged, so that checking the ink stripe on the ink applicator roller 16 can also be performed. This ink stripe can be used, for example, for checking the contact between the ink distributor roller 15 and the ink applicator roller 16.

In a further refinement, the CCD sensor 21 can be arranged on a threaded spindle 24, which is driven by a motor 25. As a result of the rotational movement of the threaded spindle 24, the CCD sensor 21 is moved to and fro along the axis of the plate cylinder 20 and is therefore able to scan the ink stripe over its entire length. The motor 25 is driven by the control unit 22.

Figure 1:
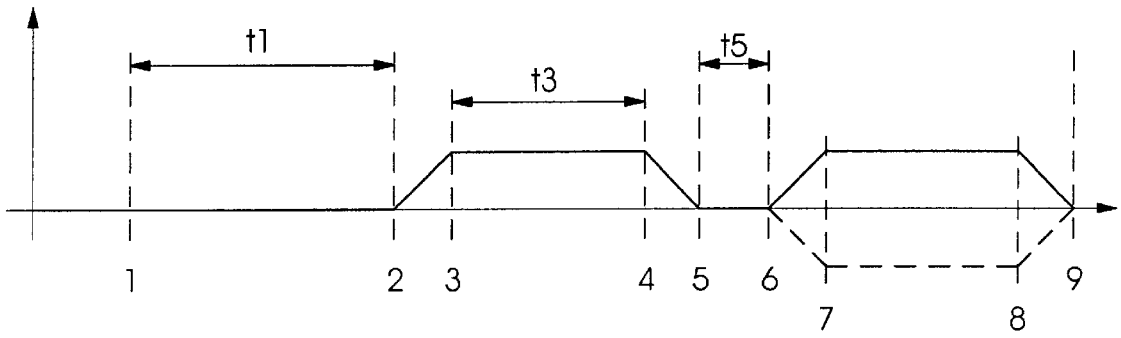
FIG. 1 is a graph wherein there are plotted, over time, individual steps taking place in the measurement according to the invention.

In FIG. 1, the rotational speed of the roller is shown against time in a printing machine wherein the invention is implemented. The individual steps shown in the drawing are stored in a memory of a control system (23) of a printing machine. These steps are therefore executed automatically and describe a method for the automatic production of an ink stripe. In this case, a plurality of programs can be stored in the control system, being assigned to the individual rollers wherein a stripe or ink stripe is to be measured. The individual programs can be called up for a specific roller via a series of push buttons or by means of multiple actuation of one push button. At the time 1, the printing machine is started up by the printing machine operator. At the same time, an alarm is triggered by the printing machine which indicates that, within a time period t1, the rollers will begin to run.

This procedure is used for safety, in order to prevent the rollers starting up while, under certain circumstances, a member of staff is still occupied in setting up the rollers and is therefore severely endangered. At the time 2, the rollers, in particular the pair of rollers to be measured (for example inking rollers) begin to run, until they have reached their normal speed at time 3. The procedure described further above of removing ink from the ink fountain and ink distribution on the rollers then takes place. When a time period t3 has elapsed from the time 3, the ink has been distributed sufficiently uniformly on the rollers (time 4). The rollers are then stopped until, at time 5, they are at a standstill, the rollers still remaining in engagement with each other under pressure until the time 6. From time 5 to time 6, a time period t5 elapses, during which an ink stripe is built up on the roller that accepts the ink from the other roller and, as a rule, reaches over the entire length of the roller. The width of the stripe is a measure of the pressure respectively prevailing between the rollers at the relevant point. The wider the stripe, the greater the pressure. If, therefore, the course of the pressure fluctuates over the length of the contact line between the two rollers, then the ink stripe also exhibits corresponding fluctuations in its width at the corresponding points. In this way, the printing machine operator is able to detect the points at which the roller pressure has to be changed in order that a constant ink stripe with the necessary thin character results.

Since the width of the strip depends not only on the pressure between the rollers but also on the duration t5 for which the rollers rest on each other at a standstill, the holding time t5 is the same during all the measurements for the rollers of one machine. In this case, the width of the ink stripe depends only on the contact pressure between the rollers. The holding time t5 for a machine will be defined in such a way that, in any case, a well-defined ink stripe results. It must be possible to detect this stripe well even when the contact pressure between the rollers is quite weak. After the holding time t5 has elapsed, the program switches on the drive for the rollers at time 6, and the rollers then run up until they have reached their normal speed at time 7. The "normal" speed, here, may be different from the normal speed during the time period t3. In fact, it is preferred to rotate the rollers at a slower speed during the time from 7 to 8 because all that is required is a relatively small rotation (<360°). The rollers are driven by the control system up to the time 8, when the program then stops the rollers until they come to a standstill at time 9. The angle covered by the roller with the ink stripe to be measured from the time 6 to the time 9 is predetermined. It is the angle which is needed in order to rotate the roller carrying the ink stripe from the position wherein it receives the ink stripe into the angular position wherein the ink stripe can be inspected by the printing machine operator and access can be had to the roller. At the time 9, the roller has come to a standstill. From this time, the protective device can be moved up, since with the roller stationary, the risk of injury is low. The roller is then located in a rotational position wherein the ink stripe can be detected very well and wherein position the copy of the ink stripe necessary for measuring the stripe can easily be prepared. As indicated by the dashed ramp between the time 6 and the time 9, the roller rotation may also be reversed until the roller reaches an angular position wherein the ink stripe can be viewed by the operator.

We claim:

1. A method of determining a mutual adjustment of two rollers, which comprises:

placing a first roller carrying a medium selected from the group consisting of moisture medium and ink in contact with a second roller;

running the rollers for a first period of time for transferring an amount of the medium from the first roller to the second roller and thereby forming a stripe of the medium on the second roller;

stopping the rollers and keeping the rollers at a standstill for a second period of time;

rotating the rollers more slowly than during the running step into a position suitable for measuring the stripe on the second roller; and when the second roller has reached the position suitable for measuring the stripe, measuring the stripe of the medium on the second roller.

2. The method according to claim 1, wherein the first and second rollers are two inking rollers mounted in a printing unit of a printing machine.

3. The method according to claim 1, which comprises rotating the rollers with a rotational speed of approximately 60 revolutions per hour.

4. The method according to claim 1, which comprises rotating the rollers with a peripheral speed of about 1 meter/minute.

* * * * *